US005535710A

United States Patent [19]

Zoschke et al.

[11] Patent Number: 5,535,710

[45] Date of Patent: Jul. 16, 1996

[54] ARRANGEMENT OF VALVES AND VALVE DRIVES IN AN INTERNAL COMBUSTON ENGINE HAVING AN OVERHEAD CAMSHAFT

[75] Inventors: Armin Zoschke, Herzogenrath; Manfred Arnold; Franz Fischinger, both of Aachen, all of Germany

[73] Assignee: FEV Motorentechnik GmbH & Co. Kommanditgesellschaft, Aachen, Germany

[21] Appl. No.: 415,130

[22] Filed: Mar. 30, 1995

[30] Foreign Application Priority Data

Mar. 31, 1994 [DE] Germany ..... 9405442 U

[51] Int. Cl.[6] ..... F01L 1/26; F01L 1/24; F01L 1/04; F01L 1/18

[52] U.S. Cl. ..... 123/90.23; 123/90.27; 123/90.4; 123/90.46; 123/432

[58] Field of Search ..... 123/90.22, 90.23, 123/90.27, 90.39, 90.4, 90.41, 90.42, 90.44, 90.43, 90.46, 308, 315, 432

[56] References Cited

U.S. PATENT DOCUMENTS

| | | | |
|---|---|---|---|
| 4,917,059 | 4/1990 | Umeda | 123/90.43 |
| 4,922,867 | 5/1990 | Mathews | 123/90.4 |
| 5,119,776 | 6/1992 | Bakker | 123/90.27 |
| 5,150,672 | 9/1992 | Fischer et al. | 123/90.22 |
| 5,261,361 | 11/1993 | Speil | 123/90.22 |
| 5,365,894 | 11/1994 | Hackett | 123/90.22 |

FOREIGN PATENT DOCUMENTS

| | | | |
|---|---|---|---|
| 0144179 | 6/1985 | European Pat. Off. . | |
| 0504128 | 9/1992 | European Pat. Off. . | |
| 0503145 | 9/1992 | European Pat. Off. . | |
| 0570963 | 11/1993 | European Pat. Off. . | |
| 1298103 | 6/1969 | Germany . | |
| 1451949 | 7/1969 | Germany . | |
| 1576267 | 7/1970 | Germany . | |
| 1906882 | 9/1970 | Germany . | |
| 4031462 | 5/1991 | Germany | 123/90.22 |

*Primary Examiner*—Weilun Lo
*Attorney, Agent, or Firm*—Spencer & Frank

[57] ABSTRACT

In an internal combustion engine there is provided a cylinder head; a plurality of cylinder head bolts for securing the cylinder head to a cylinder block; at least one engine cylinder; at least two intake valves and two exhaust valves controlling the flow of gases into and from the engine cylinder. A plane defined by the intake valves and a plane defined by the exhaust valves extend at an angle of between 0° and 15° to one another and have an inclined orientation to the longitudinal engine axis. An overhead camshaft extends parallel to the engine axis and is situated in a zone bounded by the cylinder head bolts. Respective valve bridges interconnect the intake valves with one another and the exhaust valves with one another, and rocker arms connect respective cams of the camshaft with the valve bridges, whereby the intake valves are simultaneously operated by one cam and the exhaust valves are simultaneously operated by another cam.

11 Claims, 2 Drawing Sheets

ARRANGEMENT OF VALVES AND VALVE DRIVES IN AN INTERNAL COMBUSTON ENGINE HAVING AN OVERHEAD CAMSHAFT

CROSS REFERENCE TO RELATED APPLICATION

This application claims the priority of German Application No. G 94 05 442.8 filed Mar. 31, 1994, which is incorporated herein by reference.

BACKGROUND OF THE INVENTION

In piston-and-cylinder-type internal combustion engines, whether Otto or diesel engines, each cylinder is, for reasons of combustion technology, associated with two intake valves and two exhaust valves. The intake valves, on the one hand, and the exhaust valves, on the other hand, are actuated simultaneously corresponding to the operational cycle of the engine. Particularly in diesel engines the cylinder head also has to accommodate an injection device.

In engines having a camshaft disposed at a level under the cylinder head, in which case the valve actuation is effected by push rods and rocker arms, few positional problems, if any are encountered because above the valves sufficient free space can be reserved for the required additional aggregates as it is described, for example, in German Offenlegungsschriften (applications published before examination) 12 98 103, 14 51 949, 15 76 267 and 19 06 882.

In a more compact construction as required particularly in personal automotive vehicles, the camshaft has been relocated to extend at a level above the valves in the zone of the cylinder head and the valves which are to be simultaneously actuated are connected with a coupling mechanism so that the valves to be actuated simultaneously can be operated by a single cam. Such an arrangement is disclosed, for example, in Published European Applications 0 144 179, 0 503 145 and 0 570 963. The prior art constructions disclosed therein, however, generally make it necessary to provide separate camshafts for the operation of the intake valves, on the one hand and for the operation of the exhaust valves, on the other hand. Published European Patent Application 0 144 179, in addition to the arrangement of two overhead camshafts (FIG. 2) proposes an embodiment having a sole overhead camshaft (FIG. 4). In the latter case, the construction is such that each valve is associated with its own rocker arm which involves a significantly complex construction. Furthermore, the last-outlined arrangement is not adapted for fuel-injected engines, particularly diesel engines, because no required free space is available for accommodating the injection device which is to be placed between the valve openings.

Published European Patent Application 0 504 128 describes a cylinder head for an internal combustion engine in which the simultaneously operated valves are actuated by a single camshaft by means of differently oriented cams. The valves to be operated simultaneously are connected with one another by a valve bridge which is engaged by one end of a rocker arm while its other end contacts the associated cam of the camshaft by a follower roller. In such an arrangement, however, the camshaft is situated laterally adjacent the cylinder outline defined by the cylinder head bolts so that a disassembly of the cylinder head is possible only after removal of the valve drive.

SUMMARY OF THE INVENTION

It is an object of the invention to provide an improved cylinder head for an internal combustion engine which is simplified as compared to known arrangements both in construction and assembly and which, at the same time, may be of a very compact construction.

This object and others to become apparent as the specification progresses, are accomplished by the invention, according to which, briefly stated, in an internal combustion engine there is provided a cylinder head; a plurality of cylinder head bolts for securing the cylinder head to a cylinder block; at least one engine cylinder; at least two intake valves and two exhaust valves controlling the flow of gases into and from the engine cylinder. A plane defined by the intake valves and a plane defined by the exhaust valves extend at an angle of between 0° and 15° to one another and have an inclined orientation to the longitudinal engine axis. An overhead camshaft extends parallel to the engine axis and is situated in a zone bounded by the cylinder head bolts. Respective valve bridges interconnect the intake valves with one another and the exhaust valves with one another, and rocker arms connect respective cams of the camshaft with the valve bridges, whereby the intake valves are simultaneously operated by one cam and the exhaust valves are simultaneously operated by another cam.

The invention as outlined above has a number of advantages when viewed in an overall combination of its features. By virtue of the fact that for the operation of the valves only a single overhead camshaft is provided which is oriented parallel to the longitudinal engine axis, the losses resulting from the friction of the valve drive may be significantly reduced. In addition to cost reduction which results from the use of but a single camshaft, it is an advantage that a sufficient free space for the installation and removal of the nozzle holder is available which is of particular significance in engines—particularly diesel engines—operating on direct injection. By virtue of the fact that the camshaft is situated above the cylinder within the zone delimited by the cylinder head bolts, the engine may be constructed such that the cylinder head is preassemblable and that the valve drives need not be removed prior to the removal of the cylinder head. The feature that the axes of the intake valves on the one hand and the axes of the exhaust valves on the other hand define planes that are at least approximately parallel to one another and are at an inclination relative to the longitudinal engine axis, results in an advantageous swirling gas intake. The "twist"—required for reasons of combustion—of the thus-defined gas intake direction relative to the longitudinal engine axis may be realized without adversely affecting the advantages of the free access to the zone of the cylinder axis as required, for example, for a nozzle holder.

According to an advantageous feature of the invention, the bearings for the camshaft are each provided with a bearing cap which has a throughgoing opening for a cylinder head bolt. This arrangement is advantageous in that the camshaft bearing assembly may still extend within the zone delimited by the four cylinder head bolts and the longitudinal axis of the bearing assembly is located close to two cylinder head bolts. The cylinder head bolts are, as a result of this arrangement, accessible without the need for first releasing the bearing caps for the camshaft.

According to another advantageous feature of the invention, the valve bridge cooperates with an angular displacement preventing device which may be provided on the cylinder head as a valve bridge guiding arrangement. In accordance with another feature of the invention, such an angular displacement is prevented by recesses in the valve bridge into which extend the stem ends of the valves in a form-fitting manner. This arrangement has the advantage that in the cylinder head a simple cylindrical bore or a simple cylindrical guide pin may be provided on which the valve bridge may be mounted with a respective corresponding guide pin or a corresponding guide bore. In such an arrangement it is the cooperation between the two adjoining valve stems—received in the respective recess provided in the valve bridge—that prevent an angular displacement of the valve bridge.

According to another feature of the invention, the valve bridge between the inserts for the valve stem ends is guided by a sliding fit between a tubular blind bore provided in the valve bridge and a guide pin mounted on the cylinder head. Further, the blind bore is provided with an air vent. This arrangement has the advantage that the tubular guide, in conjunction with the guide pin, acts as a stationary piston with a movable cylinder so that upon upward and downward movement of the valve bridge in such a "cylinder chamber" oil mist is drawn in through the air vent to thus provide for a sufficient lubrication in a structurally simple manner.

DESCRIPTION OF THE PREFERRED EMBODIMENT

Figure 1:
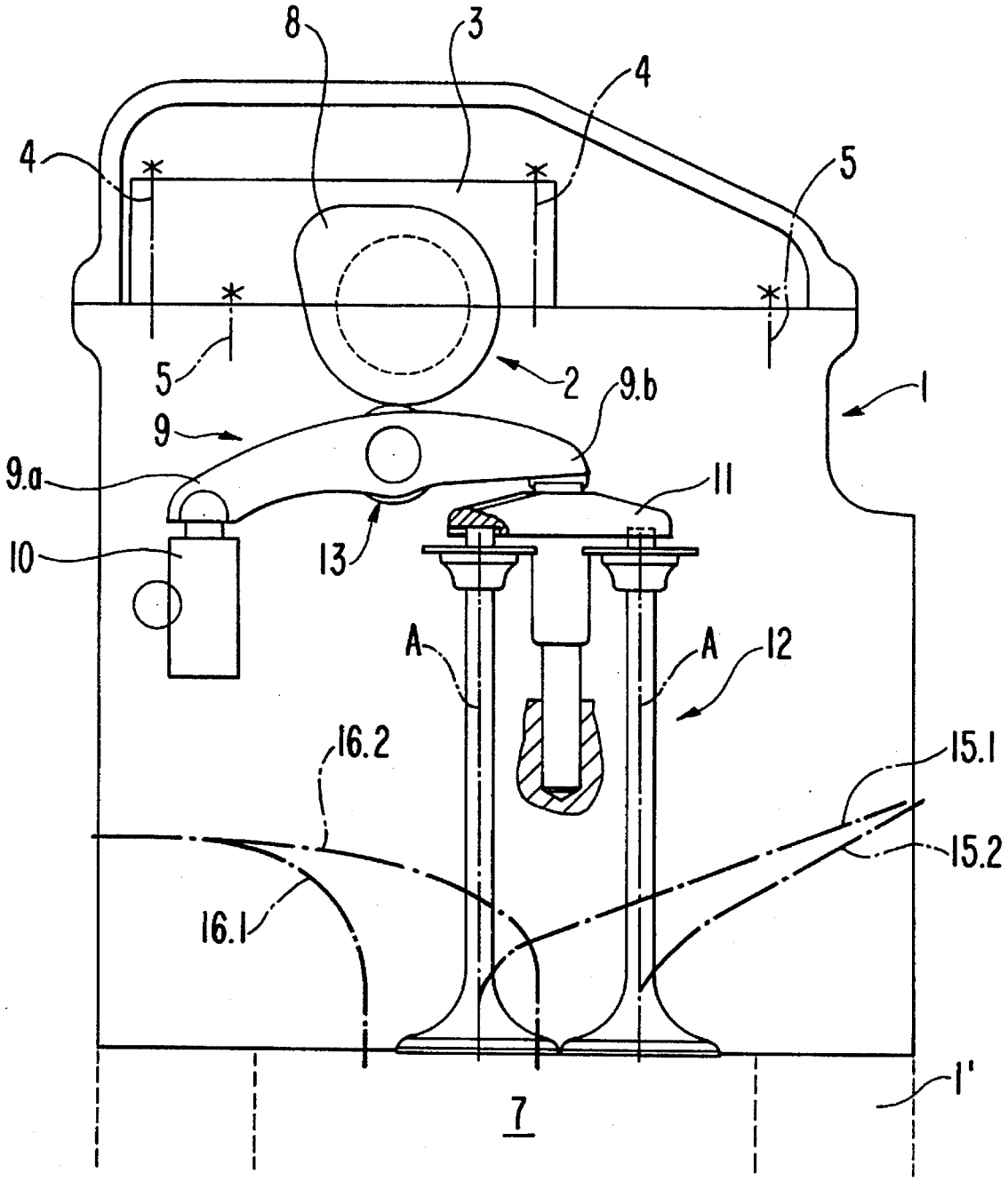
FIG. 1 is a schematic sectional front elevational view of a cylinder head incorporating a preferred embodiment of the invention.

Turning to FIG. 1, there is shown therein a cylinder head 1 on which a camshaft 2 is supported by bearings accommodated by appropriate bearing recesses in the cylinder head 1. A bearing cap 3 covers each bearing recess and is secured to the cylinder head 1 by securing bolts 4. The cylinder head 1 is secured to the engine block 1' (shown only symbolically in FIG. 1) by means of four cylinder head bolts 5. As may be observed upon considering FIGS. 1 and 2 together, the camshaft 2 is offset relative to the axis 6 of an engine cylinder 7 such that although the camshaft 2 extends laterally adjacent the cylinder axis 6, it is situated within the zone delimited by the cylinder head bolts 5.

The camshaft 2 is provided with the required number of cams 8 which, corresponding to their function as actuating elements for the intake valves on the one hand and for the exhaust valves on the other hand, are accordingly oriented. For each engine cylinder 7 a single cam 8 is provided to actuate the intake valves and a single cam 8 to actuate the exhaust valves.

As seen in FIG. 1, with each respective cam 8 there is associated a separate rocker lever 9 which, with its "fixed" end 9.*a*, is in engagement with a lash adjuster 10 which may be a mechanical or, as illustrated, a hydraulic assembly. The "movable" end 9.*b* of the rocker lever 9 engages the top of a valve bridge 11 which is operatively connected with a valve pair 12. The rocker lever 9 is operatively connected with the associated cam 8 by means of a follower roller 13.

Figure 2:
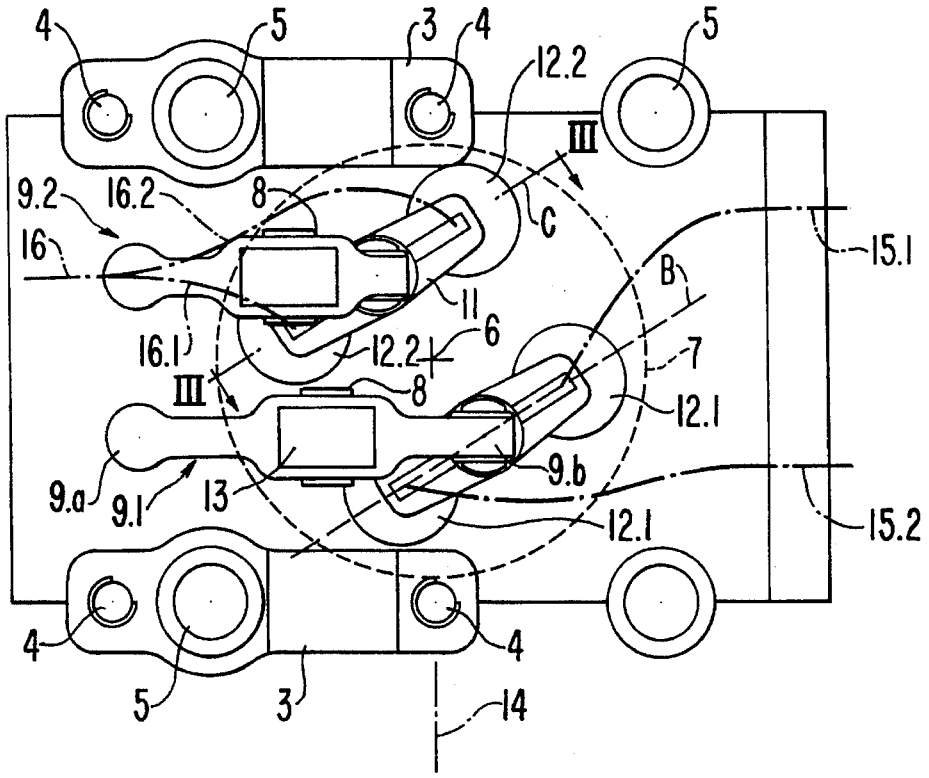
FIG. 2 is a top plan view of the construction shown in FIG. 1.

As seen in FIG. 2, for the cylinder 7 there are provided two intake valves 12.1 and two exhaust valves 12.2 situated side-by-side parallel to one another. The axes A of the intake valves 12.1 define a plane B, while the axes A of the exhaust valves 12.2 define a plane C (which in FIG. 2 contains the section line III—III). The two planes are oriented parallel to one another and are inclined at an angle of, for example, 60° to the longitudinal engine axis 14. Accordingly, for the intake channels 15.1 and 15.2 there is obtained an intake gas flow direction which results in a swirl in the cylinder chamber. The outlet channels 16.1 and 16.2 associated with the exhaust valves 12.2 merge within the cylinder head 1 into a common exhaust channel 16. In FIGS. 1 and 2 the course of the intake channels 15.1 and 15.2 as well as the course of the exhaust channels 16.1 and 16.2 is shown only symbolically by a dash-dot line for the sake of simplicity and better visibility of other components. The purpose of the representation in FIG. 1 is merely to show the basic arrangement of the camshaft relative to the valves.

As seen in FIG. 2, with each valve pair 12.1 and 12.2 an identically structured valve bridge 11 is associated. Each valve bridge 11 is actuated by a separate associated rocker arm 9. In the arrangement illustrated, the intake valves 12.1 are actuated by the rocker arm 9.1, whereas the exhaust valves 12.2 are actuated by the rocker arm 9.2. In this arrangement of valves and valve bridges, in the extension of the cylinder axis 12 in the cylinder head 1 a significant free space is available in which the nozzle holder and/or a spark plug may be accommodated.

Figure 3:
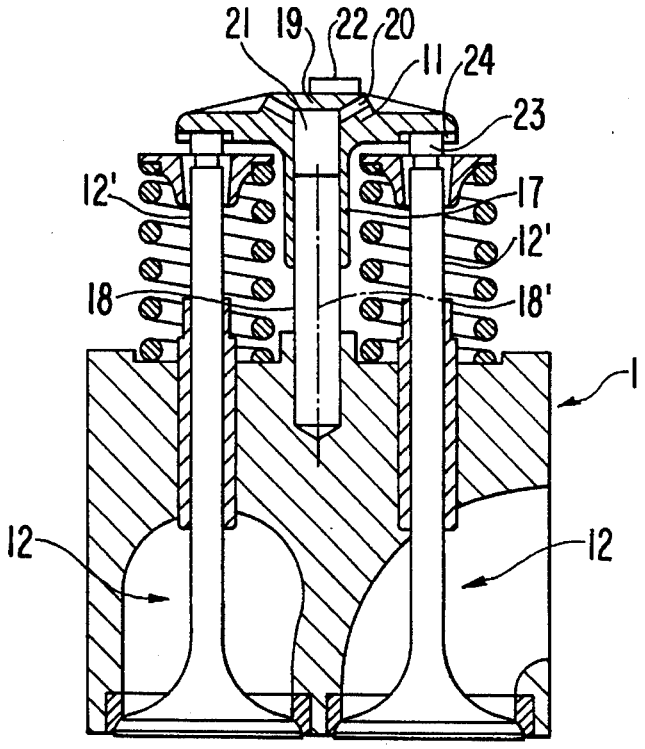
FIG. 3 is a sectional view taken along line III—III of FIG. 2.

FIG. 3 shows further details of the valve bridge 11 and adjacent components. The valve bridge 11 is displaceably guided by means of a tubular guide (blind bore) 17 slidably accommodating a guide pin 18 which is affixed to the cylinder head 1. The closed bottom 19 of the tubular guide 17 is provided with vent openings 20 so that upon upward or downward motion of the valve bridge 11 the inner space 21 remaining above the guide pin 18 functions in conjunction with the guide pin 18 as a work chamber of a piston/cylinder unit and, accordingly, air is expelled or drawn through the vents 20 from or, respectively, into the space 21. Upon suction, the air entrains oil mist so that an automatic lubrication of the valve bridge guide 17, 18 is effected.

On the outer face of the top of the valve bridge 11 lateral webs 22 are provided, between which the end 9.*b* of the rocker arm is restrained. On the underside of the valve bridge 11, in each instance in the zone of the free ends 23 of the valve stems 12', recesses 24 are provided which laterally surround the valve stems so that the valve bridge is, by means of the form-fitting engagement between the ends 23 and the recesses 24 secured against angular displacement about the pin axis 18'.

As seen readily in FIG. 2, a structure of the cylinder head as described above may be applicable to a multi-cylinder engine as well. In such a case, the cylinder head bolts 5 are to be arranged between each two adjoining cylinders so that in a multi-cylinder engine, for example, in a two-cylinder engine the number of the bearing lids will be one more than the number of the cylinders.

Preferably, the valve pairs as described above in conjunction with a preferred embodiment arranged parallel to one another in order to achieve possibly large valve cross sections. Inasmuch as in the zone between the planes defined by the valve pairs a spark plug is to be arranged, these planes may also be arranged at an inclination to one another. The magnitude of the angle of inclination is, however, limited by the requirement for large valve cross sections and should generally not exceed approximately 10°–15°.

It will be understood that the above description of the present invention is susceptible to various modifications, changes and adaptations, and the same are intended to be comprehended within the meaning and range of equivalents of the appended claims.

What is claimed is:

1. An internal combustion engine having a longitudinal engine axis and comprising (a) a cylinder head;

(b) a plurality of cylinder head bolts for securing the cylinder head to a cylinder block;

(c) at least one engine cylinder;

(d) at least two intake valves controlling the flow of intake gases into said engine cylinder; said intake valves having respective longitudinal axes defining a first plane;

(e) at least two exhaust valves controlling the flow of exhaust gases from said engine cylinder; said exhaust valves having respective longitudinal axes defining a second plane; said first and second planes extending at an angle of between 0° and 15° to one another and having an inclined orientation to said longitudinal engine axis;

(f) an overhead camshaft extending parallel to said longitudinal engine axis and being supported by said cylinder head; said camshaft being situated in a zone bounded by said cylinder head bolts; said camshaft having a longitudinal axis and first and second axially spaced cams;

(g) first and second movable valve bridges respectively interconnecting said intake valves with one another and said exhaust valves with one another;

(h) first support means for positioning said first and second movable valve bridges on said cylinder head;

(i) first and second rocker arms connecting said first cam with said first movable valve bridge and said second cam with said second movable valve bridge, respectively, whereby said intake valves are simultaneously operated by said first cam and said exhaust valves are simultaneously operated by said second cam;

(j) second support means for positioning said first and second rocker arms on said cylinder head;

(k) a bearing supporting said camshaft; and (l) a bearing cap secured to said cylinder head and having an opening for one of said cylinder head bolts.

2. The internal combustion engine as defined in claim 1, wherein said inclined orientation of said first and second planes to said engine axis is 60°.

3. The internal combustion engine as defined in claim 1, further comprising a follower member coupling each said rocker arm to a respective said cam.

4. The internal combustion engine as defined in claim 3, wherein said follower member comprises a roller.

5. The internal combustion engine as defined in claim 1, wherein said second support means comprises a lash adjuster.

6. The internal combustion engine as defined in claim 5, wherein said lash adjuster is a hydraulic lash adjuster.

7. The internal combustion engine as defined in claim 1, further comprising guard means for preventing an angular displacement of at least one of said first and second movable valve bridges.

8. The internal combustion engine as defined in claim 7, wherein said guard means comprises recesses provided in said at least one movable valve bridge; said intake valves and said exhaust valves each having a valve stem; the valve stems of the valves connected with said at least one movable valve bridge form fittingly extending into respective said recesses.

9. The internal combustion engine as defined in claim 1, wherein said first and second movable valve bridges have identical shapes and dimensions.

10. The internal combustion engine as defined in claim 1, wherein said first support means for at least one of said first and second movable valve bridges comprises a guide pin secured to said cylinder head between the valves connected to said at least one movable valve bridge and projecting therefrom; a tubular blind bore provided in said at least one movable valve bridge; said pin being slidably received in said tubular blind bore; and a venting opening being provided in said tubular blind bore.

11. The internal combustion engine as defined in claim 1, wherein said first and second planes extend parallel to one another.

* * * * *

UNITED STATES PATENT AND TRADEMARK OFFICE

CERTIFICATE OF CORRECTION

PATENT NO. : 5,535,710
DATED : July 16, 1996
INVENTOR(S) : Armin Zoschke et al

It is certified that error appears in the above-indentified patent and that said Letters Patent is hereby corrected as shown below:

On the title page, item [54], the last word on line 2 should read --COMBUSTION--.

On the title page, item [75], the third inventor's last name should read --Pischinger--.

Signed and Sealed this
First Day of October, 1996

Bruce Lehman

*Attest:*

BRUCE LEHMAN

*Attesting Officer*

*Commissioner of Patents and Trademarks*